United States Patent [19]

Takeda et al.

[11] 4,425,490

[45] Jan. 10, 1984

[54] PROGRAMMABLE ELECTRONIC COOKING APPARATUS

[75] Inventors: Sadao Takeda; Yooichi Kyoori, both of Fuji, Japan

[73] Assignee: Tokyo Shibaura Denki Kabushiki Kaisha, Kawasaki, Japan

[21] Appl. No.: 322,695

[22] Filed: Nov. 18, 1981

[30] Foreign Application Priority Data

Nov. 20, 1980 [JP] Japan ..... 55-163926

[51] Int. Cl.[3] ..... H05B 6/68

[52] U.S. Cl. ..... 219/10.55 B; 219/10.55 C; 219/506; 368/9; 99/325; 340/655; 340/652

[58] Field of Search ..... 219/10.55 B, 10.55 C, 219/10.55 R, 10.55 D, 492, 506; 368/1, 9, 10, 11, 12; 340/652, 654, 655; 126/197, 190; 99/325

[56] References Cited

U.S. PATENT DOCUMENTS 4,203,101 5/1980 Towsend ..... 340/655 X
4,232,210 11/1980 Oida et al. ..... 219/10.55 C
4,378,487 3/1983 Maeda ..... 219/10.55 B X

FOREIGN PATENT DOCUMENTS 55-85825 6/1980 Japan .

*Primary Examiner*—B. A. Reynolds
*Assistant Examiner*—Philip H. Leung
*Attorney, Agent, or Firm*—Cushman, Darby & Cushman

[57] ABSTRACT

When a door of a microwave oven is opened during a programmed cooking operation, a door open monitoring circuit provides a door open signal to a microcomputer so that the microcomputer interrupts to execute the programmed cooking operation. A control circuit measures time lapsed from the re-closure of the door to provide the microcomputer with a control signal indicative of whether a cooking switch has been operated within a predetermined period of time after the re-closure of the door. In response to the control signal, the microcomputer executes the remaining programmed cooking operation in case that the cooking switch has been operated within the predetermined period of time or clears it otherwise. The function of the control circuit may be performed by the microcomputer.

5 Claims, 24 Drawing Figures

PROGRAMMABLE ELECTRONIC COOKING APPARATUS

BACKGROUND OF THE INVENTION

This invention relates to programmable electronic cooking apparatus constructed to effect the cooking of food in accordance with a programmed cooking operation as in a microcomputer-controlled microwave oven.

Various electronic cooking apparatus constructed to effect a food cooking process under the control of a microcomputer according to a programmed cooking sequence, have been in practical use. In a microcomputer-controlled microwave oven, for example, a magnetron is deenergized from the safety standpoint immediately when the door of a cooking (heating) chamber is opened during cooking.

While the magnetron stops oscillating with the opening of the magnetron energizing circuit, the content of program stored in the microcomputer is not cleared at this time, but merely the progress of the program is interrupted. Thus, if the food taken out from the heating chamber by opening the door is not perfectly cooked yet, it may be returned into the heating chamber, and the interrupted cooking program may be resumed by closing the door again and then depressing a cooking switch button. On the other hand, if the food is perfectly cooked, it is no longer returned into the heating chamber, and the remaining programmed cooking operation remains without being cleared. In this case, if the cooking switch button is depressed by mistake after closing the door of the heating chamber again, which is empty at this time, the magnetron is operated in response to the remaining cooking program, for instance, a programmed temperature in a temperature cooking mode. Consequently, electromagnetic energy that is generated from the magnetron is not absorbed by any food in the heating chamber but is reflected by the inner chamber wall, thus giving rise to various problems such as the life reduction and characteristic deterioration of the magnetron, dissolving of parts and generation of spark. In the worst case, a fire hazard is prone.

SUMMARY OF THE INVENTION

An object of the invention, accordingly, is to provided a safe and long life electronic cooking apparatus constructed to effect a food cooking process according to a programmed cooking operation, with which even if a cooking switch is depressed a predetermined period of time after the heating chamber door has been opened during cooking of food to take out the food, the remaining portion of the programmed cooking operation is not resumed.

This object of the invention is attained by a programmable electronic cooking apparatus having a food cooking chamber, an opening for putting food into and taking it out of the chamber, a door provided on the opening, means for supplying food cooking energy to the chamber, and means coupled to a cooking switch, for controlling the energy supply means so that the cooking of food can proceed according to a programmed cooking operation, comprising: means for detecting whether the door is opened during the cooking operation and for interrupting the execution of the programmed cooking operation, timer means for measuring time elapsed from the re-closure of the door, and means for causing the controlling means to execute the remaining programmed cooking operation if the cooking switch has been operated during a predetermined period of time measured by the timer means while clearing the remaining programmed cooking operation if the period of time has been elapsed without operation of the cooking switch.

DETAILED DESCRIPTION OF THE PREFERRED EMBODIMENTS

Figure 1:
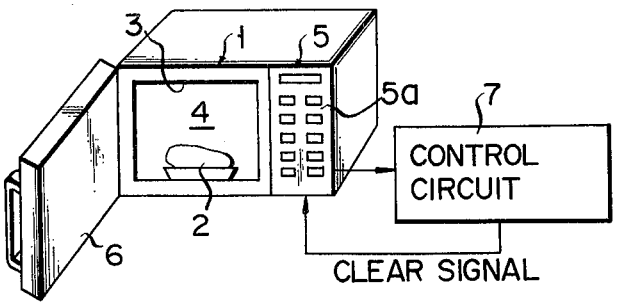
FIG. 1 is a schematic showing the principles of an embodiment of the invention applied to a microcomputer-controlled microwave oven.

Referring now to FIG. 1, a microcomputer-controlled microwave oven 1 includes a food cooking (heating) chamber 4 having an opening 3, through which food 2 is put into and taken out of the chamber 4, and a control section 5. A door 6 is provided to open and close the opening 3. The control section 5 includes an input section 5*a* provided with a power switch, a timer switch, a temperature setting switch, a cooking switch and a clear switch and an operating section having a microcomputer for executing programmed cooking process in response to operation signals of the input section 5*a*. The control section 5 is provided with a control circuit 7, to which a signal for opening or closing the door 6 and a cooking signal representing the cooking process formed by operating the cooking switch are supplied. When the door 6 is opened during the cooking process to interrupt the cooking, this is detected by a door open monitoring circuit (not shown). When the cooking switch is not operated within a predetermined period of time, for instance 20 seconds elapsed from the re-closure of the door 6, a clear signal is supplied from the control circuit 7 to the microcomputer provided in the control section 5, whereby the remaining program is cleared. However, when the cooking switch is depressed within the predetermined period of time after the re-closure of the door 6, the microcomputer executes the remaining programmed cooking operation. In addition, whenever the clear switch (not shown) may be operated, the microcomputer clears the programmed cooking operation.

Figure 2:
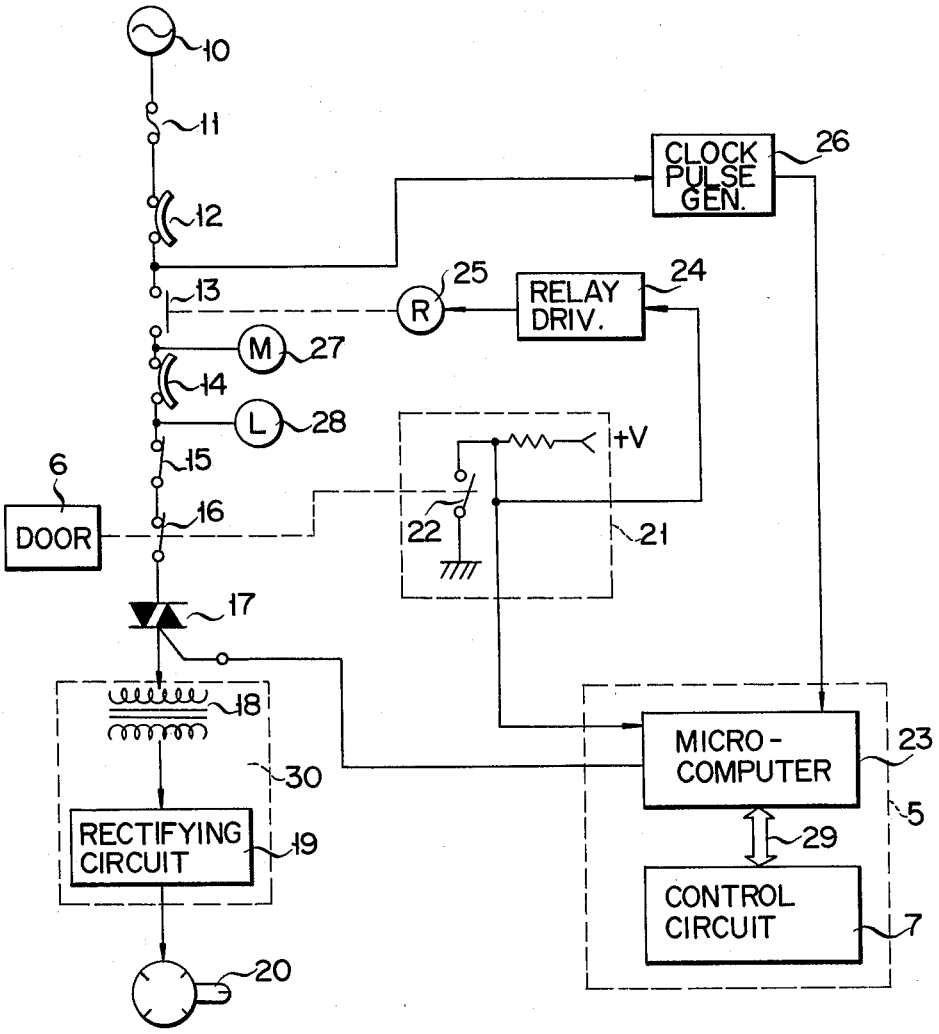
FIG. 2 is a block diagram showing the circuit construction of the embodiment shown in FIG. 2.

FIG. 2 shows a block diagram of the whole circuit construction of the microwave oven shown in FIG. 1. Power, for instance 120 V, 60 Hz single-phase alternating current power, is supplied from a commercial power source 10 through a fuse 11, an oven thermostat 12, a direct current relay contact 13, an magnetron thermostat 14, interlock switches 15 and 16 and a bidirectional thyristor 17 to the primary winding of a high voltage transformer 18 in a high voltage regulator 30. A high voltage output of the secondary winding of the high voltage transformer 18 is converted in a rectifying circuit 19 into a direct current voltage which is supplied to a magnetron 20. The interlock switch 16 is interconnected with the door 6 and also with a switch 22 in a door open monitoring circuit 21. The switch 16 is closed when the door 6 is closed and opened when the door is opened. The switch 22 is opened when the door 6 is closed, whereby the output of +V, for instance 10 volts, from the circuit 21 is supplied as a door close signal to a microcomputer 23 provided in the control section 5. When the door 6 is opened, the switch 22 is closed, whereby the output of 0 volt is supplied from the circuit 21 as a door open signal to the microcomputer 23. When the door 6 is opened, a direct current relay driver 24 is driven by the output of the circuit 21, causing current through the direct current relay coil 25 to open the direct current relay contact 13 so as to stop the oscillation of the magnetron 20.

A clock pulse generator 26, a blower motor 27 and an oven lamp 28 are also connected to the alternating line leading from the power source 10 to the high voltage transformer 18. A clock pulse generator 26 supplies a clock pulse signal as a time base signal to the microcomputer 23. The bidirectional thyristor 17 is an element for controlling power supplied to the magnetron 20, and the conduction state thereof is controlled in response to a power control signal from the microcomputer 23. The microcomputer 23 and control circuit 7 are coupled together by a bidirectional bus 29, and various signals including the clear signal shown in FIG. 1 go back and forth through this bus 29. For example, when the door open/close detection signal from the circuit 21 is supplied to the microcomputer 23, a corresponding signal is delivered from the microcomputer 23 through the bus 29 to the control circuit 7.

Figure 3:
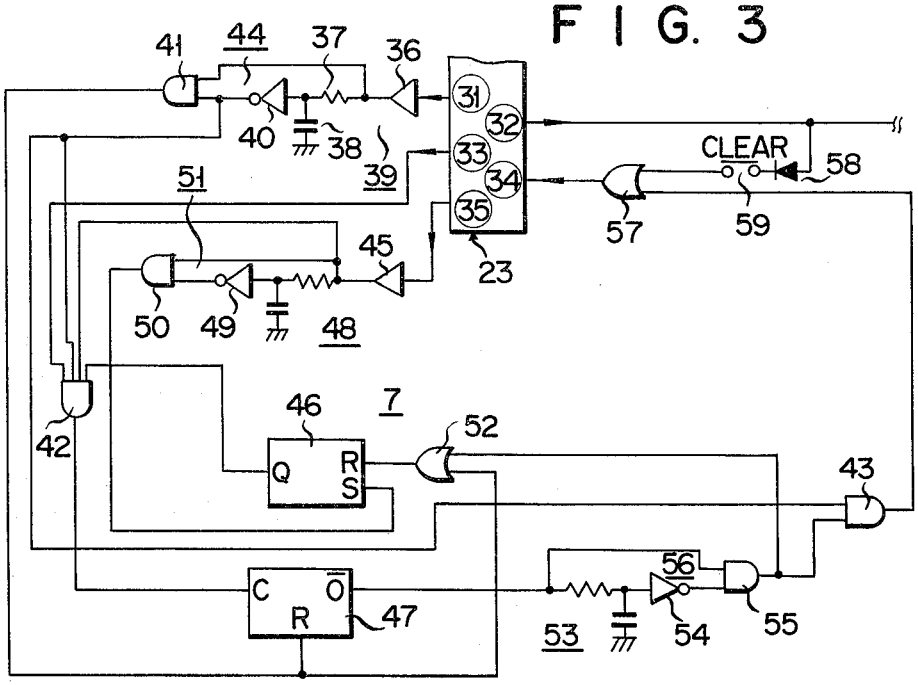
FIG. 3 is a block diagram of a control circuit shown in FIG. 2.

FIG. 3 is a block diagram showing an example of the circuit construction of the control circuit 7. In FIG. 3, a microcomputer 23 includes a cooking signal output pin 31, digit signal output pins 32 and 33, a clear signal input pin 34 and a door open/close signal output pin 35. The cooking signal output pin 31 provides a binary signal, which is at 10 volts during cooking operation and at 0 volt otherwise. The door open/close signal output pin 35 provides a binary signal, which is at 10 volts when the door 6 is closed and at 0 volt when the door is open.

The cooking signal of the output pin 31 is transmitted through an amplifier 36 to an integrating circuit 39 including a resistor 37 and a capacitor 38. The output of the integrating circuit 39 is inverted through an inverter 40, the output of which is fed to one input terminal of each of AND gates 41, 42 and 43. The output of amplifier 36 is directly fed to the other input terminal of the AND circuit 41. The integrating circuit 39, inverter 40 and AND gate 41 constitute a one-shot trigger circuit 44, and a pulse of a predetermined duration corresponding to the output of the amplifier 36 is provided from the AND gate 41. To the AND gate 42 are fed the output of the digit pin 33, an amplified door open/close signal of the amplifier 45, the Q output of a flip-flop circuit 46 and the output of the inverter 40. The pulse output of the AND gate 42 is fed to the input terminal C of a decimal counter 47. The output of the amplifier 45 is supplied to a one-shot trigger circuit 51 including an integrating circuit 48, an inverter 49 and an AND circuit 50. The pulse output of the one-shot trigger circuit 51 is supplied to the set terminal of the flip-flop circuit 46.

The output of the AND gate 41 is fed to the reset input terminal R of the decimal counter 47 and also to the input terminal of an OR gate 52. The Q output of the decimal counter 47 is supplied to a one-shot trigger circuit 56 including an integrating circuit 53, an inverter 54 and an AND gate 55. The output of the one-shot trigger circuit 56 is fed to the other input terminal of OR gate 52 and to the other input terminal of the AND gate 43. The output of the OR gate 52 is fed to the reset input terminal R of the flip-flop circuit 46. The output of the AND gate 43 is fed to one input terminal of the OR gate 57. The digit output of the digit pin 32 is supplied through a diode 58 and a clear switch 59 to the other input terminal of the OR gate 57. The output of the OR gate 57 is fed to the clear signal input pin 34 of the microcomputer 23. The clear switch 59 is provided in the input section 5*a*.

The operation of the control circuit 7 shown in FIG. 3 will now be described with reference to FIGS. 4 and 5.

Figure 4:
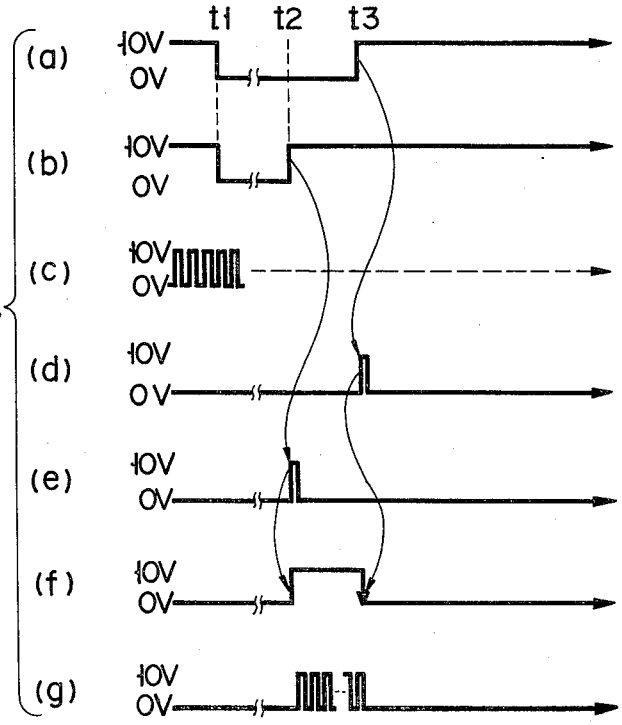
FIGS. 4 and 5 are timing charts for illustrating the operation of the circuit shown in FIG. 3.
Figure 5:
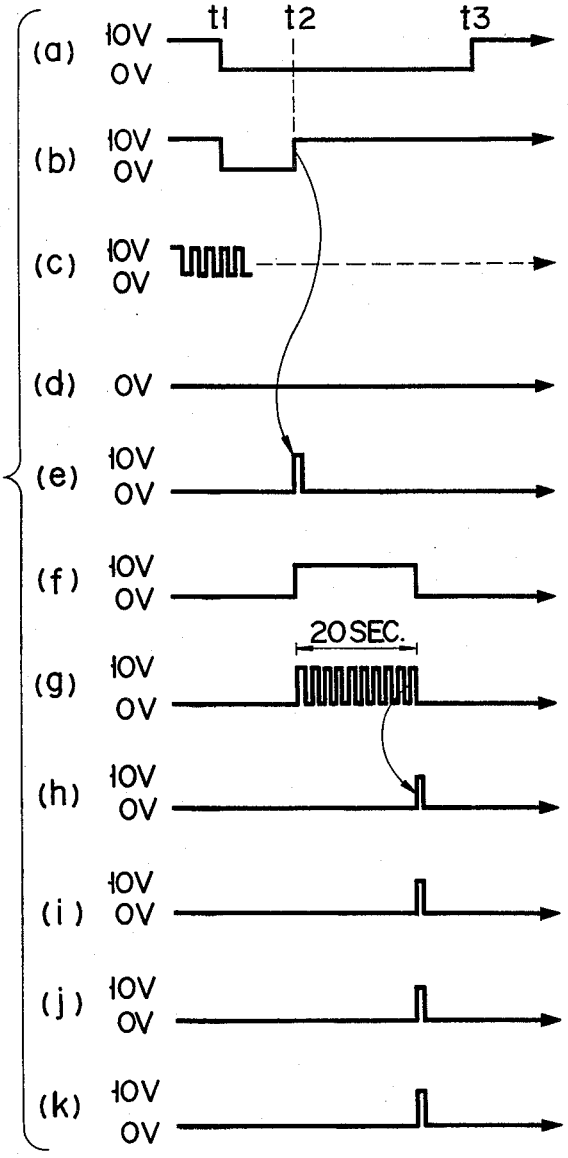

While the door 6 is closed during cooking, the cooking signal provided from the cooking signal output pin 31 of the microcomputer 23 is at 10 volts as shown in FIG. 4(*a*). When the door 6 is opened at an instant t1, the signal is reduced to 0 volt. The door open/close signal is at 10 volts up to the instant t1 as shown in FIG. 4(*b*), and it is reduced to 0 volt with the opening of the door 6 at the instant t1. This digit signal provided from the output pin 33 is shown in FIG. 4(*c*).

When the door 6 is closed again at the instant t2, the door open/close signal is changed to 10 volts as shown in FIG. 4(*b*). With this rising of the door open/close signal, a door re-closure signal as shown in FIG. 4(*e*), is transmitted from the AND gate 50 of the one-shot trigger circuit 51 to the set terminal S of the flip-flop circuit 46, whereupon the Q output of the flip-flop circuit 46 rises to 10 volts as shown in FIG. 4(*f*). The AND gate 42 is enabled in response to the outputs of the inverter 40 and amplifier 45 and Q output of the flip-flop 46, whereby the digit signal of the pin 33 is passed through the AND gate 42 to the clock input terminal C of the decimal counter 47 for counting as shown in FIG. 4(*g*). One period of the digit signal of the pin 33 is set to 2 seconds, for example. Thus, when 20 seconds is elapsed from the instant t2, a carry output pulse is transmitted from the decimal counter 47 to the one-shot trigger circuit 56.

When the cooking switch provided in the control section 5 is depressed at an instant t3 before the lapse of 20 seconds from the instant t2, the cooking signal shown in FIG. 4(*a*) rises to 10 volts. As a result, a cooking restart signal as shown in FIG. 4(*d*), is provided from the AND gate 41 of the one-shot trigger circuit 44, thus resetting the decimal counter 47. At the same time, the flip-flop circuit 46 is reset in response to the cooking restart signal through the OR gate 52, whereupon the Q output of the flip-flop circuit 46 falls as shown in FIG. 4(*f*) to disable the AND gate 42. Thus, the digit signal is no longer supplied to the decimal counter 47. If no carry output is provided from the decimal counter 47, the one-shot trigger circuit 56 remains inoperative, and no clear signal is transmitted from the OR gate 57 to the clear pulse input pin 34 of the microcomputer 23. The microcomputer 23 is not cleared unless the clear switch 59 is operated. If the cooking switch is operated within 20 seconds from the re-closure of the door 6, the remaining cooking program stored in the microcomputer 23 is thus progressively executed to conduct the intended cooking operation.

Now, the operation that takes place when the cooking switch is depressed after the lapse of time longer than 20 seconds from the re-closure of the door 6, will be described with reference to FIG. 5. When the door 6 is opened at an instant t1, the cooking signal falls to 0 volt as shown in FIG. 5(*a*), and also the door open/-close signal is reduced to 0 volt as shown in FIG. 5(*b*). When the door 6 is closed again at a subsequent instant t2, the door signal is changed to 10 volts again as shown in FIG. 5(*b*). As a result, a pulse as shown in FIG. 5(*e*) is provided from the AND gate 50, thus setting the flip-flop circuit 46. The set output Q of the flip-flop circuit 46 rises to 10 volts as shown in FIG. 5(*f*) to enable the AND gate 42, whereby the digit pulse with one period of 2 seconds as shown in FIG. 5(*c*) is taken out through the AND gate 42 as shown in FIG. 5(*g*). The digit pulse taken out is supplied to the clock terminal C of the decimal counter 47. After the lapse of subsequent 20 seconds, 10 digit pulses are counted by the decimal counter 47, a carry signal as shown in FIG. 5(*h*) is transmitted from the counter 47 to the one-shot trigger circuit 56. As a result, a pulse with a pulse duration of 20 msec as shown in FIG. 5(*i*) is transmitted from the one-shot trigger circuit 56 to the AND gate 43. Since at this time the cooking signal remains at 0 volt as shown in FIG. 5(*a*) without the cooking switch operated, the output of the inverter 40 is at high level, and the AND gate 43 is in the enabled state. Thus, an output of a pulse duration of 20 msec as shown in FIG. 5(*j*) is obtained from the AND gate 43. The output is supplied to the OR gate 57, whereby the pulse output shown in FIG. 5(*k*) is supplied as a clear pulse to the clear signal input pin 34 of the microcomputer 23. The pulse duration of the clear pulse given to the clear signal input pin 34 of the microcomputer 23 is set to be shorter than 20 msec.

As a result, the remaining cooking content programmed in the microcomputer 23, is all cleared. Subsequently, even when the cooking signal is caused to go to high level as shown in FIG. 5(*a*) with the cooking switch depressed by mistake at an instant t3, no cooking operation is brought about since the cooking program stored in the microcomputer 23 has been already cleared. Since at this time the oscillation of the magnetron 20 is not started, deterioration of the characteristic and reduction of service life can be prevented. Also, there is no possibility of fire hazard, dissolution of part or spark phenomenon. Further, no unnecessary microwave generation occurs, which is advantageous from the standpoint of saving energy.

The microcomputer 23 used in this embodiment may include a single-chip microprocessor, a product sold with a model number of "μPD546" by Nippon Electric Co., Ltd. (NEC). Since the "μPD546" is provided with a clear signal input pin, when a clear pulse with a pulse duration shorter than 20 msec as shown in FIG. 5(*k*) is given, all the remaining programmed data such as cooking temperature and cooking time are all cleared.

In the above embodiment the clear signal is generated by the control circuit 7 separately from the microcomputer 23 as shown in FIGS. 2 and 3. However, it is also possible to assemble a program on the microcomputer 23 such that it includes a function of the role of the control circuit 7. By so doing, the circuit construction can be simplified.

Figure 6:
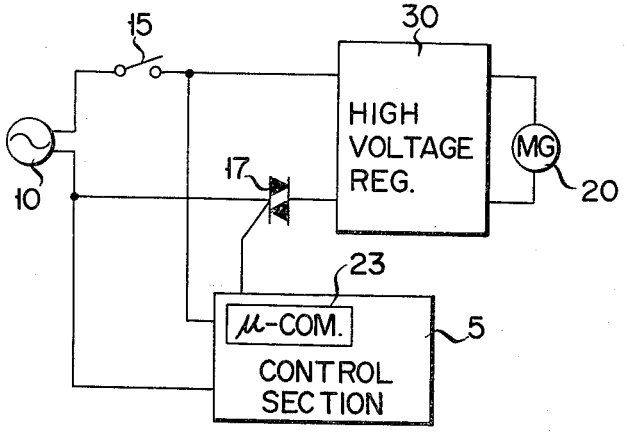
FIG. 6 is a block diagram of another embodiment of the invention.

FIG. 6 shows a block diagram showing the principles of another embodiment, which is based upon the concept mentioned above. In FIG. 6, a high voltage regulator 30 is connected through a bidirectional thyristor 17 to a 120 V AC power source 10. The output of the high voltage regulator 30 is supplied to a magnetron 20 for causing oscillation thereof. The bidirectional thyristor 17 is controlled for conduction by the output of a control section 5 including the microcomputer 23. The microcomputer 23 in this embodiment is constructed such that it also serves the function of the control circuit 7 in the preceding embodiment of FIG. 3. Thus, like the preceding embodiment the cooking program stored in the microcomputer 23 is cleared a predetermined period of time after the re-closure of the door 6 having once been opened.

The embodiment of FIG. 6 will now be further described with reference to FIGS. 7 and 8.

Figure 7:
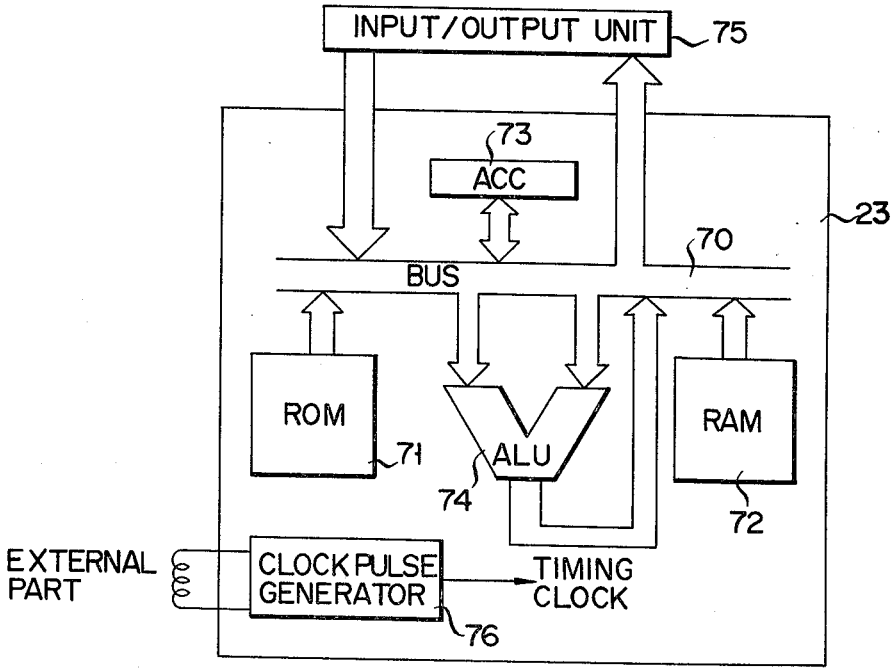
FIG. 7 is a block diagram of a microcomputer used in the embodiment of FIG. 6.
Figure 8:
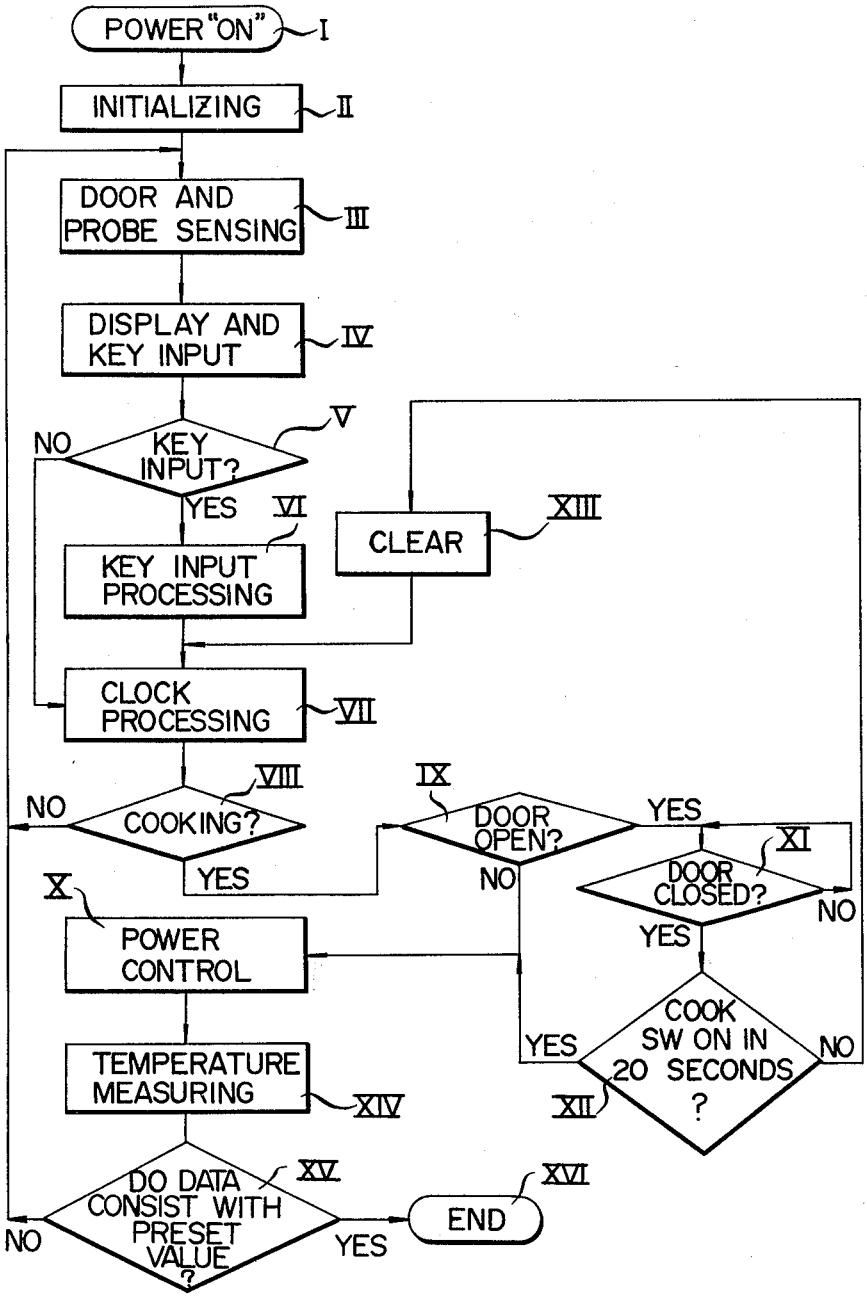
FIG. 8 is a flow chart showing the operation of the embodiment shown in FIGS. 6 and 7.

FIG. 7 shows a basic block diagram of the microcomputer 23 shown in FIG. 6. A ROM 71, a RAM 72 and an accumulator (ACC) 73, these parts constituting a memory unit, are coupled to a bus 70. Further, an arithmetic and logical unit (ALU) 74 and an input/output (I/O) circuit 75 are coupled to the bus 70. The microcomputer 23 further includes a timing control unit (not shown) and a clock pulse generator 76, which generates a timing clock signal for the individual units 71 to 75. In the ROM 71, user's application program and fixed data are stored. In the RAM 72, the result of operation in the ALU 74 and also other data obtained by processing in accordance with cooking instructions are stored. In the ACC 73, only one word of the result of operation in the ALU 74 and other data to be processed by instructions is temporarily stored. The ALU 74 functions to perform arithmetic and logical operations and judgment for the operations. In the ALU 74, a predetermined arithmetic operation is performed for the cooking according to a user's application program stored in the ROM 71, for instance by using input data from the input section 5*a* shown in FIG. 1, through the I/O unit 75.

The operation of the embodiment shown in FIGS. 6 and 7 will now be described by using the program flow chart shown in FIG. 8. In the first place, food 2 is put into the food heating chamber 4 shown in FIG. 1, and then the door 6 is closed. Thereafter, a power supply button provided on the input section 5*a* is depressed to start a step I shown in FIG. 8. After the power "on" state, a well-known auto-clear (initializing) routine stored in the ROM 71 is executed to clear the contents of the RAM 72, and the ACC 73, and a step II represents such an initialization. In this embodiment of a microwave oven, a thermistor sensor probe provided for detecting the temperature of cooked food is set in the food, if necessary, in the heating chamber 4 for detecting the state of progress of the temperature cooking mode.

In a subsequent step III, whether the door 6 is closed and also whether the probe is set in the food in the temperature cooking mode are checked. The checking as to whether the door 6 is open or closed may be effected by reading data representing the output level of the monitoring circuit 21 as shown in FIG. 2 and comparing it with reference level data stored in the ROM 71. The "probe-in-use" state of the probe is judged if current caused through the thermistor is detected. When the door 6 is closed and the probe is plugged in, the operation proceeds to a step IV.

In the step IV, an operation of a display section provided in the input section 5*a* for the display of temperature, heating time, etc. and a preparatory operation for accepting keyed-in data from temperature and heating time keys, are set.

In this state, whether there is any key input in the input section 5a is detected in a step V. When temperature and heating time data for cooking are keyed in by the user, a step VI is executed.

In the step VI, the keyed-in temperature and heating time data are transferred through the I/O unit 75 to the RAM 72 and stored in predetermined memory locations thereof.

When the key input processing is completed, a next clock processing step VII is executed. In this step, a second signal is formed using the power source frequency of 60 Hz. This second signal may be used at the time of time cooking, that is, it may be used for causing the down-counting of a set value, in which a predetermined time period is preset, one down count for every second. In case if no key input is detected in the key input detection step V, the operation also jumps from the step V to the step VII.

In a step VIII, whether the cooking switch has been depressed is checked. If it is detected that the cooking switch has been depressed, program steps of a user's application program are successively read out from the ROM 71 for executing predetermined arithmetic and logical operation in the ACC 73 and ALU 74 using the cooking conditions (such as temperature and time data) written in the RAM 72. The result is stored in the RAM 72. If the cooking switch is not depressed, the program returns to the step III.

When the user opens the door 6 for confirming the progress of cooking during cooking as checked in the step VIII, this is detected in a step IX. If the door 6 is not opened, the power control step X is executed, in which an on-off signal is sent to the control gate of the bidirectional thyristor 17 at a predetermined timing. The conduction period of the bidirectional thyristor 17 is controlled for controlling power supplied to the magnetron 20.

If it is detected in the step IX that the door has been opened, the program control shifts to a step XI, in which whether the door 6 is closed again is detected. If it is detected that the door 6 has been closed again, the program control moves to a step XII.

In the step XII, whether the cooking switch has been turned "on" within 20 seconds from the re-closure of the door 6 is detected. If it is detected that the switch has been turned on within 20 seconds, the cooking program control shifts to the step X to effect the power control of the magnetron 20 again. If it is detected that the cooking switch has been turned on after the lapse of 20 seconds, the program control moves to a clear step XIII, in which all the cooking data keyed-in by the user are cleared. The operation of counting 20 seconds, is effected by reading out 20-second data from the ROM 71 at the timing of re-closure of the door 6 as detected in the step XI and causing the counting-down for 20 seconds in the ALU 74 using the second signal formed in the step VII. After the lapse of 20 seconds, the clear data may be read out at this timing, and it may be sent to the clear pulse input pin 34 of the microcomputer 23.

If the cooking switch is turned on within 20 seconds, the program control moves to the power control step X. This control step X is followed by a temperature measuring step XIV. In this step, the food's temperature is measured by the sensor probe, and the measurement data obtained is stored in the RAM 72. Under the temperature cooking mode, the measured temperature data is compared with a preset temperature stored in the RAM 72 in a step XV.

When the measured data is not consistent with the preset temperature in the step XV, the program control shifts back to the step III, and the successive steps III through XIV are repeatedly executed. However, if the measured data is consistent with the preset temperature stored in the RAM 72, the program control comes to an end at the step XVI.

What we claim is:

1. An programmable electronic cooking apparatus comprising:

a food cooking chamber, an opening for putting food into and taking it out of said chamber, a door provided on said opening, means for supplying food cooking energy to said chamber, a cooking switch, means, coupled to said cooking switch, for controlling said energy supply means so that cooking of food can proceed according to a programmed cooking operation, means for detecting whether said door is opened during a cooking operation and for interrupting the execution of the programmed cooking operation;

timer means for measuring time elapsed from a re-closure of the door after an opening thereof during a cooking operation; and means for causing said controlling means to (a) execute the remaining programmed cooking operation interrupted by a door opening, if said cooking switch is operated during a predetermined period of time measured by said timer means, and (b) to clear the remaining programmed cooking operation if the period of time has been elapsed without operation of said cooking switch.

2. The electronic cooking apparatus according to claim 1, wherein said detecting means includes a door open monitoring switch positioned so as to be controlled by the door.

3. The electronic cooking apparatus according to claim 1, wherein said controlling means includes:

a microcomputer; and a control circuit for forming a clear signal for clearing said remaining programmed cooking operation and supplying it to a clear pulse input pin of said microcomputer.

4. The electronic cooking apparatus according to claim 3, wherein said control circuit includes:

means for counting a digit signal in response to a door re-closure signal provided from said microcomputer;

an AND gate to which a carry signal from said counting means and the cooking signal are fed; and means for supplying the output of said AND gate to the clear pulse input pin of said microcomputer.

5. The electronic cooking apparatus according to any one of claims 1–4, wherein said energy supply means includes a power source, a thyristor, a voltage regulator and a magnetron, and said means controls the conduction of said thyristor so that cooking temperature of the food can reach a preset value in accordance with a programmed cooking operation.

* * * * *